US007743833B2

(12) United States Patent
Cascario et al.

(10) Patent No.: US 7,743,833 B2
(45) Date of Patent: Jun. 29, 2010

(54) PRESSURE BALANCED PISTON FOR SUBSURFACE SAFETY VALVES

(75) Inventors: Dario Cascario, Abruzzo (IT); Ben Lake, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 12 days.

(21) Appl. No.: 12/019,478

(22) Filed: Jan. 24, 2008

(65) Prior Publication Data

US 2009/0188662 A1 Jul. 30, 2009

(51) Int. Cl.
*E21B 34/10* (2006.01)

(52) U.S. Cl. ..... 166/375; 166/332.8; 166/386

(58) Field of Classification Search ..... 166/332.8, 166/375, 386, 53, 54; 137/494
See application file for complete search history.

(56) References Cited

U.S. PATENT DOCUMENTS

| | | | | |
|---|---|---|---|---|
| 4,986,357 | A * | 1/1991 | Pringle | 166/319 |
| 5,338,001 | A * | 8/1994 | Godfrey et al. | 251/58 |
| 6,109,351 | A | 8/2000 | Beall | |
| 6,173,785 | B1 | 1/2001 | Adams et al. | |
| 6,427,778 | B1 | 8/2002 | Beall et al. | |
| 7,591,317 | B2 * | 9/2009 | Bane et al. | 166/375 |
| 2003/0094285 | A1 * | 5/2003 | French | 166/380 |
| 2008/0066921 | A1 * | 3/2008 | Bane et al. | 166/316 |
| 2008/0128137 | A1 * | 6/2008 | Anderson et al. | 166/319 |
| 2008/0314599 | A1 * | 12/2008 | Bane et al. | 166/375 |

OTHER PUBLICATIONS

Calhoun, M.B., et al., "Subsurface Safety Systems for TLP Completions", SPE 12296, Oct. 1984, 8 pages.
Hill, T.H., et al., "A New Completion System for Surface-Controlled Subsurface Safety Valves" Journal of Petroleum Technology, Mar. 1974, 331-336.
Morsi, K.M., "Surface and Downhole Production Safety Systems for Sour Oil and Gas Wells", SPE 13743, Mar. 1985, 10 pages.
Bussear, Terry, et al., "Design and Qualification of a Remotely-Operated, Downhole Flow Control System for High-Rate Water Injection in Deepwater", SPE 88563, Oct. 2004, 1-8.

* cited by examiner

*Primary Examiner*—William P Neuder
*Assistant Examiner*—Elizabeth C Gottlieb
(74) *Attorney, Agent, or Firm*—Steve Rosenblatt

(57) ABSTRACT

A control system for a subsurface safety valve references the surrounding annulus to put the operating piston in pressure balance. Depending on the configuration and which seal in the system fails, the various embodiments can differ in their failure modes. With the lower end of the piston exposed to annulus pressure all failure modes close the flapper. With the lower end of the piston exposed to tubing pressure, failure of any of the seals except one will result in flapper closure.

21 Claims, 4 Drawing Sheets

PRESSURE BALANCED PISTON FOR SUBSURFACE SAFETY VALVES

FIELD OF THE INVENTION

The field of this invention is control systems for operating subsurface safety valves and more particularly control systems with a piston in pressure balance to the surrounding annulus.

BACKGROUND OF THE INVENTION

Subsurface safety valves are operated from the surface normally through control lines that run outside the production tubing. These valves are typically of the flapper type where a control system, when pressurized from the surface overcomes a closure spring on a flow tube to push the flapper 90 degrees into the open position behind the shifting flow tube. Removal of pressure from the control system allows the closure spring that had previously been held in a compressed position to then push the flow tube away from the flapper so that a torsion spring can bias it back against its seat to prevent flow from the formation from going up the production string.

These systems have to deal with issues such as failing in a safe mode if one or more seals in the control system fail. They also have to address offsetting the hydrostatic pressure in the control line. Systems with a single control line down to the subsurface safety valve typically have a pressurized chamber at the valve preset with enough pressure for the expected depth of the valve to offset the control line hydrostatic pressure so that on removal of applied control line pressure from the surface, the closure spring that acts on the flow tube doesn't have to overcome the hydrostatic pressure from the control line. A single control line system that addresses fail safe failure modes of the various seals is U.S. Pat. No. 6,109,351. Alternatively a closure spring is provided that is strong enough to overcome the control line hydrostatic pressure particularly in shallower wells. Other systems simply cancel out control line hydrostatic pressure with a balance line from the opposite side of an operating piston than the main control line. One example of such systems is U.S. Pat. No. 6,173,785. Some two line systems also incorporate pressurized chambers such as U.S. Pat. No. 6,427,778.

Some of these designs employ a passage through the piston for the purpose of obtaining a fail safe closure mode if one or more of the system seals malfunction or if a control line is sheared. The prior systems typically separated tubing pressure from control line pressure and made no reference to the surrounding annulus. Typically the operating piston in the control system had to have a mechanical connection to the flow tube to move the flow tube to open the valve. That mechanical connection was exposed to tubing pressure and the operating piston featured a pair of seals in a housing so that a portion of the operating piston in the region that it connected to the flow tube was exposed to tubing pressure but remained in pressure balance from tubing pressure.

The present invention addresses alternative approaches to the past designs that reference the surrounding annulus. Some embodiments operate differently than others during failure modes and this will be explained in detail when the various embodiments are described in detail. Those skilled in the art will appreciate the various aspects of the invention from the description of the preferred embodiment and associated drawings that appear below with the understanding that the full scope of the invention is measured by the appended claims.

SUMMARY OF THE INVENTION

A control system for a subsurface safety valve references the surrounding annulus to put the operating piston in pressure balance. Depending on the configuration and which seal in the system fails, the various embodiments can differ in their failure modes. With the lower end of the piston exposed to annulus pressure all failure modes close the flapper. With the lower end of the piston exposed to tubing pressure, failure of any of the seals except one will result in flapper closure.

DETAILED DESCRIPTION OF THE PREFERRED EMBODIMENT

Figure 1:
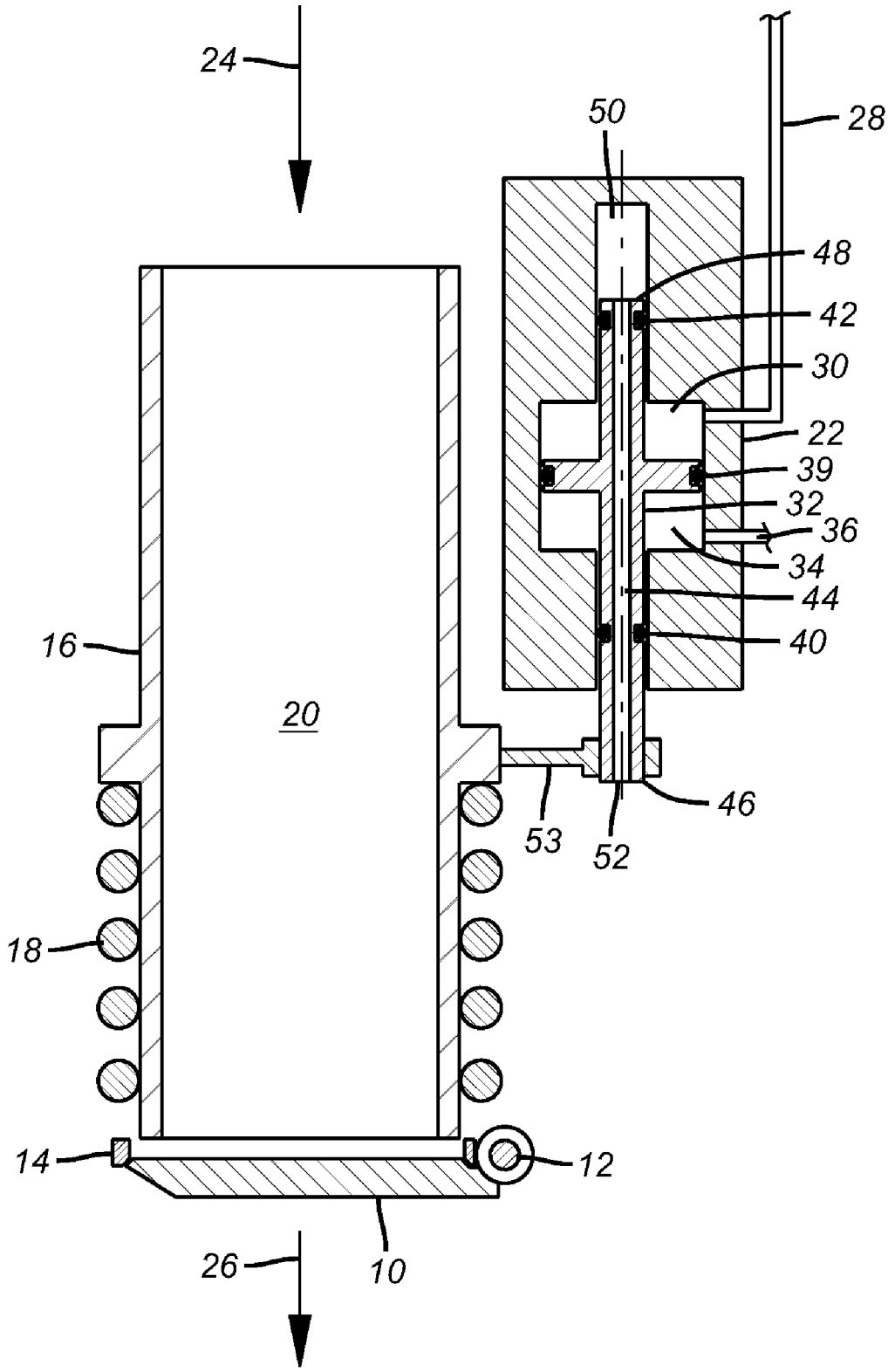
FIG. 1 is a schematic view of a single line control system with a piston pressure balanced to the annulus.

FIG. 1 is a schematic representation of a subsurface safety valve that those skilled in the art will appreciate can illustrate the various embodiments of the present invention. Typically, a flapper 10 is mounted on a pivot 12 that can combine a torsion spring (not shown) to urge the flapper 10 against the seat 14. The flapper 10 is pushed to turn 90 degrees and go behind an advancing flow tube 16 that is forced to move against a return bias from closure spring 18. Passage 20 goes through a housing that is partially shown as 22. A string from the surface represented by arrow 24 is in flow communication with passage 20 in housing 22 in a known manner. Similarly arrow 26 represents the continuation of a tubing string to the producing zone further down in the well.

A single control line 28 connects into housing 22 into chamber 30 above the operating piston 32. Chamber 34 is on the other side of piston 32 from chamber 30 and it communicates to the surrounding annulus around housing 22 through passage 36.

Piston 32 is preferably a rod piston with seals 40, a lower seal, and seal 42 an upper seal. There is a through passage 44 going from lower end 46 to upper end 48 of piston 32. Above upper end 48 is a chamber 50 in housing 22 that gets tubing pressure communicated to it through the passage 44 from inlet 52. Link 53 connects piston 32 to flow tube 16.

In operation, applied pressure from control line 28 raises the pressure in chamber 30 to the point that spring 18 is compressed and the flapper 10 goes open. Removal of pressure from the control line 28 allows the spring 18 to overcome the net difference between hydrostatic pressure in line 28 and the surrounding annulus pressure. The spring 18 is sized to overcome the net pressure on piston 32 between control line hydrostatic and annulus pressure apart from seal friction at seals 40 and 42 when piston 32 moves. Piston 32 is mechanically coupled to flow tube 16 below seal 40 which is exposed to tubing pressure on one side and annulus pressure on the other side. Seal 39, the piston seal, separates chambers 30 and 34. Seal 42 is on one side of piston seal 39 and seal 40 is on the opposite side of seal 39 from seal 40. In most cases a net closing force acts on piston 32 from tubing pressure pushing up on seal 40 and annulus pressure pushing down on seal 42.

If seal 40 fails, the pressure in the tubing will communicate to the surrounding annulus and pressurize chamber 34 forcing the piston 32 up and the flapper 10 will go closed. If seal 39 fails in any illustrated embodiment, there cannot be a pressure differential across the piston 32 from control line 28 and the closure spring 18 will make the flapper 10 close. However if seal 42 fails then tubing pressure will get into chamber 30 and prevent spring 18 from closing the flapper 10 since spring 18 is not sized for overcoming tubing pressure because the flow tube 16 is in pressure balance to tubing pressure. Hence in this embodiment, failure of seal 42 makes the valve stay open.

Figure 2:
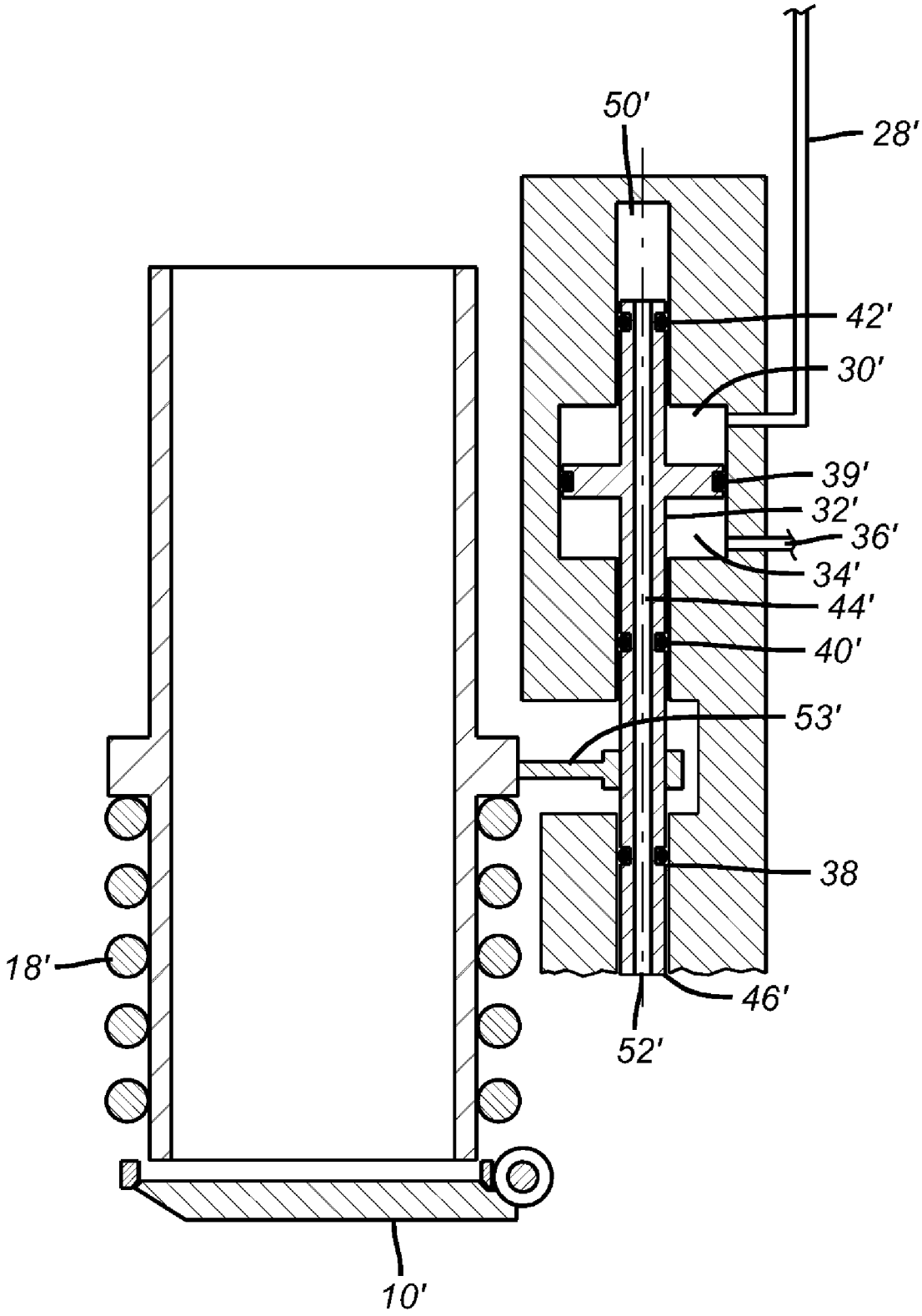
FIG. 2 is an alternative embodiment to FIG. 1 and still having a pressure balanced piston to the annulus.

FIG. 2 is a modified design of FIG. 1. The difference is that a second lower seal 38 is added and the lower 46' end of piston 32' is now exposed to annulus pressure rather than tubing pressure. Annulus pressure also goes through inlet 52' to chamber 50'. The piston 32' is in pressure balance from annulus pressure acting up on lower seal 38 and down on upper seal 42' through chamber 50'. Piston 32' is also in pressure balance from tubing pressure pushing up at seal 40' and down at seal 38 because those seals straddle the link 53' that connects the piston 32' to the flow tube 16'.

If seal 40' fails tubing pressure enters chamber 34' and the annulus through passage 36' pushing the piston 32' up and the flapper 10' will close. If seal 38 fails tubing pressure will leak into the annulus and get into chamber 34' and again the flapper 10' will close. If seal 42' breaks pressure in the control line 28' will pass into the annulus through chamber 50' and passage 44' and the closure spring 18' will be able to close the flapper 10'. The design of FIG. 2 fails closed if any seal 38, 40' and 42' fails.

Figure 3:
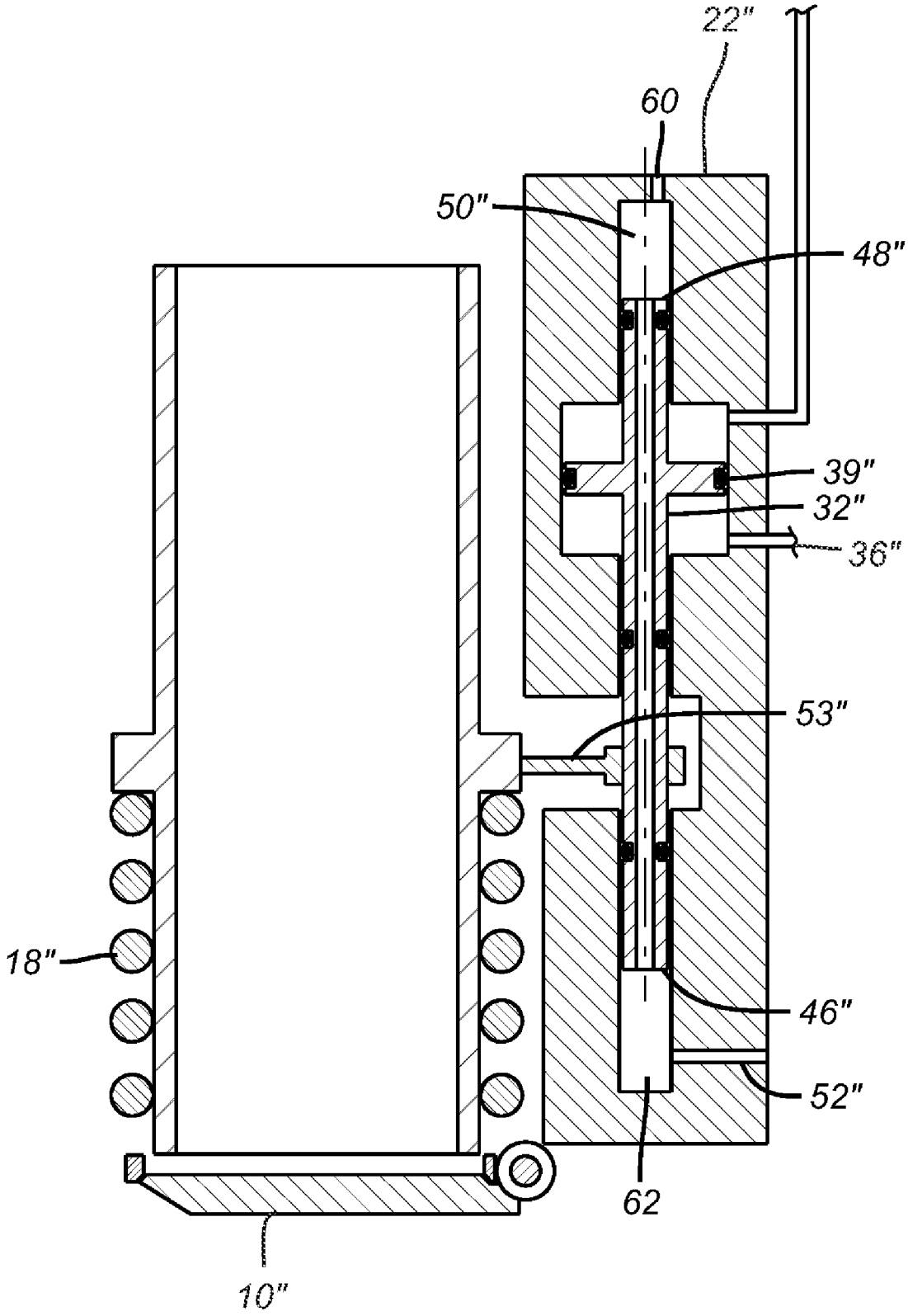
FIG. 3 is an alternative to the embodiment in FIG. 2 and having a piston in pressure balance to the annulus.

FIG. 3 is virtually the same as FIG. 2 with the difference being that piston 32" is solid and the passage through it has been eliminated. However, a connection 60 to the annulus has been added to chamber 50" so that the top 48" of the piston 32" is again in communication with the annulus despite there being no passage through piston 32". Inlet 52" exposes the lower end 46" of piston 32" to annulus pressure present in chamber 62. In all other respects, the FIG. 3 design functions and fails the same way as the FIG. 2 design.

Figure 4:
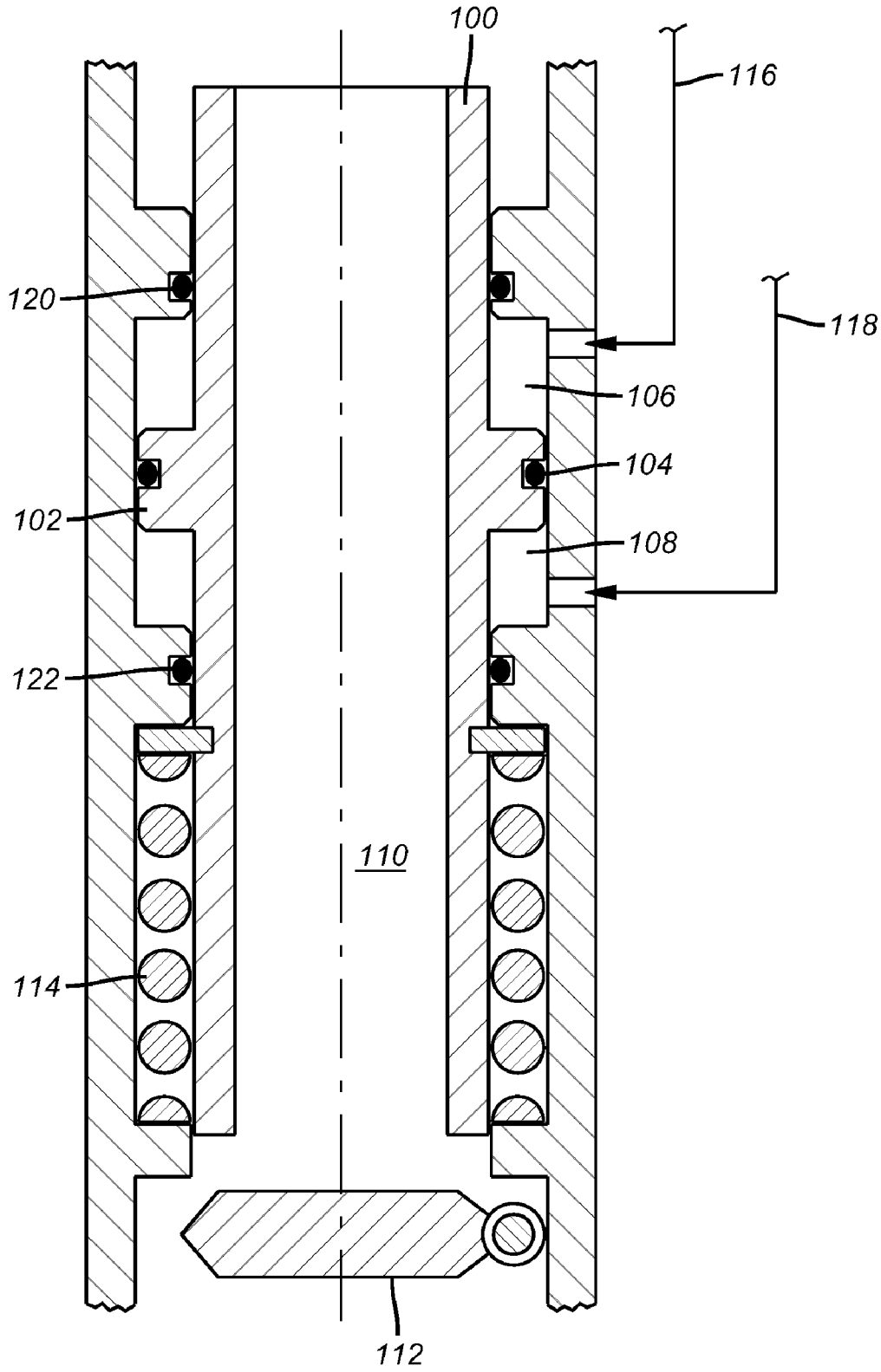
FIG. 4 is a variation of FIG. 1 showing an annular piston rather than a rod piston with a balance control line to the surface.

FIG. 4 is similar to FIG. 1 except the piston has an annular shape rather than a rod shape as illustrated in FIG. 1 and is pressure balanced with a balance line that runs to the surface. The flow tube 100 has a piston 102 integrated into it with a seal 104 to separate compartments 106 and 108. Tubing pressure is in passage 110. Downward movement of the flow tube 100 rotates the flapper 112 and compresses the spring 114. Compartment 106 is connected to a first control line represented schematically by arrow 116 and compartment 108 is connected to another control line running back to the surface and schematically represented by arrow 118. Seals 120 and 122 are preferably the same size so that piston 102 is in pressure balance from the equal hydrostatic pressure in lines 116 and 118 when no pressure is being applied to either line from the surface. Seals 120 and 122 have tubing pressure in passage 110 acting on one side and control line pressure 116 acting on the other side of seal 120 and balance line pressure 118 acting on the other side of seal 122.

In operation, the flapper 112 is opened with pressure applied in line 116 that compresses spring 114 and drives the flow tube 100 down against the flapper 112. Removal of pressure on line 116 allows the spring 114 to drive the flow tube 100 up so that the flapper 114 closes. Since there is a balance of hydrostatic forces on piston 102 the spring 114 does not have to be sized to oppose any hydrostatic force acting on piston 102 since there is no such force acting on it in this embodiment.

If seal 104 breaks then the flapper 112 will close under the force of spring 114. Failure of seal 122 will allow tubing pressure from passage 110 into chamber 108 forcing the flow tube 100 up and the flapper 112 will close. Failure of seal 120 will send tubing pressure from passage 110 to chamber 106 and will likely overpower spring 114 to hold the flapper 112 open unless pressure is applied to the control line 118.

Those skilled in the art will appreciate that a variety of control systems are disclosed that use a single control line and a pressure balanced piston with respect to the annulus. The designs that fail safe closed are also pressure balanced to tubing pressure as well. Pressure balance to the annulus can occur at opposed ends with bore through the piston or with separate exposure of opposed ends of the piston to annulus pressure. In the preferred embodiment the piston can be one or more rod pistons but other piston shapes are contemplated. Pressurized chambers or offsets for control line hydrostatic pressure are not needed. The annulus pressure is used to at least in part offset the control line hydrostatic pressure and the closure spring 18 is sized to overcome net force on the piston from the net difference in pressure acting on it from the control line trying to push it down and the annulus pressure trying to push it back up.

The above description is illustrative of the preferred embodiment and many modifications may be made by those skilled in the art without departing from the invention whose scope is to be determined from the literal and equivalent scope of the claims below.

We claim:

1. A control system for operating a downhole tool from the surface, comprising:

a tool housing having a movable member in a passage connected to a piston and a control line connection on said housing to allow pressure to be delivered to a first chamber defined by said piston for tandem movement of said piston and movable member against a bias force, said movement of said piston reducing the volume of a second chamber in said housing and isolated from said passage that is in communication with pressure downhole in an annulus around said housing a third chamber in said housing defined by a first end of said piston, said third chamber communicating to a second end of said piston by a passage through said piston, said second end of said piston isolated in said housing from said second chamber and exposed to either pressure in said passage in said housing or in said annulus.

2. The system of claim 1, wherein:

the opposed ends of said piston communicate with pressure in said passage in said housing.

3. The system of claim 1, wherein:

the opposed ends of said piston communicate with pressure downhole in an annulus around said housing.

4. The system of claim 3, wherein:

the opposed ends of said piston communicate with pressure downhole in the annulus around said housing through discrete annulus connections in said housing.

5. The system of claim 1, wherein:

said movable member comprises a flow tube movable against a closure spring to turn a flapper to an open position for flow through said passage through said housing;

said piston is linked to said flow tube in a manner where said link and a portion of said piston adjacent to it are exposed to pressure in said passage.

6. The system of claim 5, wherein:

said piston comprises a plurality of spaced seals where the failure of all but one of said seals allows the closure spring to move said flow tube to let said flapper go to a closed position.

7. The system of claim 6, wherein:

said piston comprises a piston seal, an upper seal on one side of said piston seal and a lower seal on the opposite side of said piston seal from said upper seal;

said lower seal is exposed to pressure in said passage.

8. The system of claim 5, further comprising:

a single control line connected to said control line connection to communicate surface pressure to open said flapper and upon removal of applied pressure in said control line said closure spring moves said flow tube to let said flapper close.

9. The system of claim 5, wherein:

said piston comprises a plurality of spaced seals where the failure of all of said seals allows the closure spring to move said flow tube to let said flapper go to a closed position.

10. A control system for operating a downhole tool from the surface, comprising:

a tool housing having a movable member in a passage connected to a piston and a control line connection on said housing to allow pressure to be delivered to a first chamber defined by said piston for tandem movement of said piston and movable member against a bias force, said movement of said piston reducing the volume of a second chamber in said housing that is in communication with pressure downhole in an annulus around said housing;

said movable member comprises a flow tube movable against a closure spring to turn a flapper to an open position for flow through said passage through said housing;

said piston is linked to said flow tube in a manner where said link and a portion of said piston adjacent to it are exposed to pressure in said passage;

said piston comprises a plurality of spaced seals where the failure of all but one of said seals allows the closure spring to move said flow tube to let said flapper go to a closed position;

said piston comprises a piston seal, an upper seal on one side of said piston seal and a lower seal on the opposite side of said piston seal from said upper seal;

said lower seal is exposed to pressure in said passage;

said piston seal is exposed to said control line connection on one side and the annulus pressure surrounding said housing on its opposite side;

said lower seal is exposed to annulus pressure on the side opposite from which it is exposed to passage pressure.

11. The system of claim 10, wherein:

said upper seal is exposed to said control line connection on one side and annulus pressure on the side opposite from which it is exposed to said control line connection.

12. The system of claim 11, wherein:

annulus pressure is communicated to said upper seal through a passage through said piston.

13. The system of claim 12, wherein:

failure of said piston seal or said lower seal causes said flapper to close.

14. The system of claim 11, wherein:

annulus pressure is communicated directly through said housing to said upper seal.

15. A control system for operating a downhole tool from the surface, comprising:

a tool housing having a movable member in a passage connected to a piston and a control line connection on said housing to allow pressure to be delivered to a first chamber defined by said piston for tandem movement of said piston and movable member against a bias force, said movement of said piston reducing the volume of a second chamber in said housing and isolated from said passage that is in communication with pressure downhole in an annulus around said housing;

said movable member comprises a flow tube movable against a closure spring to turn a flapper to an open position for flow through said passage through said housing;

said piston is linked to said flow tube in a manner where said link and a portion of said piston adjacent to it are exposed to pressure in said passage;

said piston comprises a plurality of spaced seals where the failure of all of said seals allows the closure spring to move said flow tube to let said flapper go to a closed position;

said piston comprises a piston seal, an upper seal on one side of said piston seal and a first and second lower seals on the opposite side of said piston seal from said upper seal with said first lower seal disposed on an opposite side of said link from said second lower seal;

both said lower seals are exposed to pressure in said passage on their respective sides closest to said link.

16. A control system for operating a downhole tool from the surface, comprising:

a tool housing having a movable member in a passage connected to a piston and a control line connection on said housing to allow pressure to be delivered to a first chamber defined by said piston for tandem movement of said piston and movable member against a bias force, said movement of said piston reducing the volume of a second chamber in said housing that is in communication with pressure downhole in an annulus around said housing;

said movable member comprises a flow tube movable against a closure spring to turn a flapper to an open position for flow through said passage through said housing;

said piston is linked to said flow tube in a manner where said link and a portion of said piston adjacent to it are exposed to pressure in said passage;

said piston comprises a plurality of spaced seals where the failure of all of said seals allows the closure spring to move said flow tube to let said flapper go to a closed position;

said piston comprises a piston seal, an upper seal on one side of said piston seal and a first and second lower seals on the opposite side of said piston seal from said upper seal with said first lower seal disposed on an opposite side of said link from said second lower seal;

both said lower seals are exposed to pressure in said passage on their respective sides closest to said link;

both said first and second lower seals are exposed to annulus pressure on the side opposite to where they are exposed to pressure in said passage.

17. The system of claim 16, wherein:

said upper seal is exposed to said control line connection on one side and annulus pressure on the side opposite from which it is exposed to said control line connection.

18. The system of claim 17, wherein:

annulus pressure is communicated to said upper seal through a passage through said piston.

19. The system of claim 17, wherein:

annulus pressure is communicated directly through said housing to said upper seal.

20. The system of claim 17, wherein:

a single control line connected to said control line connection to communicate surface pressure to open said flapper and upon removal of applied pressure in said control line said closure spring moves said flow tube to let said flapper close.

21. A control system for operating a downhole tool from the surface, comprising:

a tool housing having a movable member in a passage connected to a piston and a control line connection on said housing to allow pressure to be delivered to a first chamber defined by said piston for tandem movement of said piston and movable member against a bias force, said movement of said piston reducing the volume of a second chamber in said housing and isolated from said passage that is in communication with pressure downhole in an annulus around said housing;

the opposed ends of said piston communicate with pressure in said passage in said housing;

pressure in said passage is communicated to opposed ends of said piston through a passage in said piston.

* * * * *

UNITED STATES PATENT AND TRADEMARK OFFICE

CERTIFICATE OF CORRECTION

PATENT NO. : 7,743,833 B2
APPLICATION NO. : 12/019478
DATED : June 29, 2010
INVENTOR(S) : Dario Cascario et al.

It is certified that error appears in the above-identified patent and that said Letters Patent is hereby corrected as shown below:

Please delete Figure 3 on Drawing Sheet 3 of 4 and insert the following Figure 3:

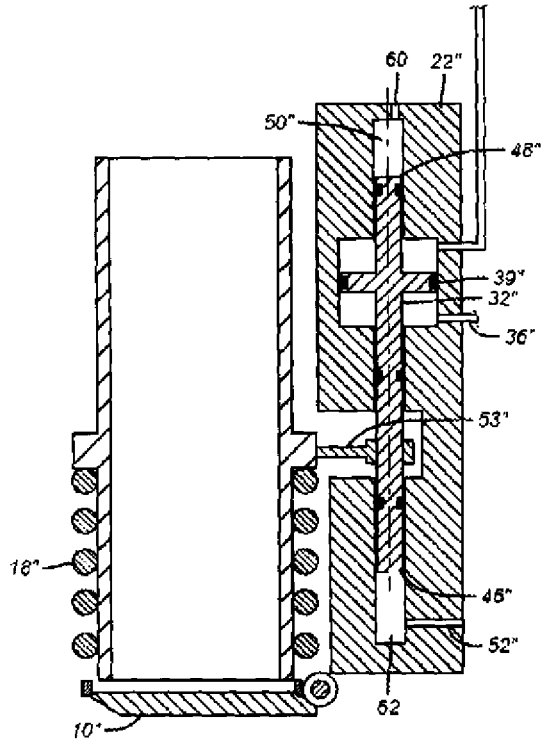

FIG. 3

Signed and Sealed this
Eleventh Day of September, 2012

David J. Kappos

David J. Kappos
*Director of the United States Patent and Trademark Office*